US008851800B2

(12) United States Patent
Patton

(10) Patent No.: US 8,851,800 B2
(45) Date of Patent: Oct. 7, 2014

(54) CONCENTRICALLY LOADED, ADJUSTABLE PIERING SYSTEM

(76) Inventor: Steven Patton, Springdale, AR (US)

( * ) Notice: Subject to any disclaimer, the term of this patent is extended or adjusted under 35 U.S.C. 154(b) by 205 days.

(21) Appl. No.: 13/526,329

(22) Filed: Jun. 18, 2012

(65) Prior Publication Data

US 2012/0255242 A1 Oct. 11, 2012

Related U.S. Application Data

(63) Continuation-in-part of application No. 12/632,572, filed on Dec. 7, 2009, now Pat. No. 8,206,063.

(60) Provisional application No. 61/141,328, filed on Dec. 30, 2008.

(51) Int. Cl.

| | |
|---|---|
| ***E02D 5/00*** | (2006.01) |
| ***B66F 3/24*** | (2006.01) |
| ***E02D 27/48*** | (2006.01) |
| ***E02B 3/06*** | (2006.01) |
| ***E01D 15/14*** | (2006.01) |

(52) U.S. Cl.

CPC . *E02D 27/48* (2013.01); *B66F 3/24* (2013.01); *E02B 3/068* (2013.01); *E01D 15/14* (2013.01); *E02D 5/00* (2013.01)

USPC ..... 405/230; 248/354.3

(58) Field of Classification Search

USPC ..... 405/230–233; 248/354.3; 52/126.1, 52/126.6, 741.15

See application file for complete search history.

(56) References Cited

U.S. PATENT DOCUMENTS

| | | | |
|---|---|---|---|
| 996,397 | A | 6/1911 | Breuchaud |
| 1,181,212 | A | 5/1916 | Clark |
| 2,801,522 | A | 8/1957 | Kuhn |
| 3,222,030 | A | 12/1965 | Thorpe |
| 5,096,333 | A | 3/1992 | Bassett |
| 5,131,790 | A | 7/1992 | Simpson |
| 5,228,807 | A | 7/1993 | Willcox, Jr. |
| 5,320,453 | A | 6/1994 | Bullivant |
| 5,399,055 | A | 3/1995 | Dutton, Jr. |
| 5,505,030 | A | 4/1996 | Michalcewiz et al. |
| 5,595,366 | A | 1/1997 | Cusimano et al. |
| 5,713,701 | A | 2/1998 | Marshall |
| 5,819,482 | A | 10/1998 | Belke et al. |
| 7,090,435 | B2 | 8/2006 | Mitchell |
| 8,206,063 | B2 | 6/2012 | Patton |
| 2002/0062622 | A1 | 5/2002 | Bell et al. |
| 2002/0095880 | A1 | 7/2002 | MacKarvich |
| 2003/0033760 | A1 | 2/2003 | Rogers et al. |
| 2008/0304919 | A1 | 12/2008 | Coyle |

*Primary Examiner* — Tara M. Pinnock
(74) *Attorney, Agent, or Firm* — Kenneth L. Green

(57) ABSTRACT

A piering system includes a heave plate attached to a foundation and supported by a pier. A downward facing socket is permanently attached to the heave plate. The socket receives the top end of a heavy stud of a coupling assembly, the bottom end of the stud is screwed into a captive nut of a shim-block. A nut is welded to the stud leaving about ½ inch of the stud protruding upwards for insertion into the socket. The nut may be turned to adjust the height of the stud. The shim-block and coupling assembly are supported by a head plate which is supported by the pier. The head plate includes a wide table for supporting a pair of jacks on opposite sides of a house jack facilitating installation of the system.

26 Claims, 5 Drawing Sheets

CONCENTRICALLY LOADED, ADJUSTABLE PIERING SYSTEM

The present application claims the priority of U.S. Provisional Patent Application Ser. No. 61/141,328 filed Dec. 30, 2008 and is a Continuation In Part of U.S. patent application Ser. No. 12/632,572 filed Dec. 7, 2009, which applications are incorporated by reference in their entirety.

BACKGROUND OF THE INVENTION

The present invention relates to piering systems and in particular to a concentrically loaded, adjustable, steel pipe foundation repair piering system.

In many areas of the United States building foundations rest on unstable soil. Changes in local condition cause soil movement and damage to the building. Piering systems are used in such areas to provide support from bedrock under the buildings. Known piering systems include piers sunk below the foundation to a stable surface, for example, bedrock. The pier system reaches up to the foundation to provide vertical support. Unfortunately, the bottom of the foundation may not provide a horizontal surface for the support to push against and movement of the foundation may result in the foundation breaking away from the support.

Further, concentrically loaded piering systems (those installed directly under the wall being supported or lifted, as opposed to being attached to the outer edge of the foundation footing) typically are easy to break with offset loads created by imperfect installation, and have loose adjusting components ("shims") that can fall off if the structure moves after installation. Piers installed directly under the wall must be installed in very short "segments". The link between the segments must be very strong to prevent breakage.

Known piering systems typically require a number of loose adjusting components (or shims) which may fall off if the structure "heaves" or moves after installation. As a result, the piering system may require adjusting after a minor soil movement due to the lost shims even if the foundation returns to the original position.

A need thus remains for an improved piering system which remains attached to the building foundation and can tolerate sloped foundation bottom surfaces.

BRIEF SUMMARY OF THE INVENTION

The present invention addresses the above and other needs by providing a piering system which includes a heave plate attached to a foundation and supported by a pier. A downward facing socket is permanently attached to the heave plate. The socket receives the top end of a heavy stud of a coupling assembly, the bottom end of the stud is screwed into a captive nut of a shim-block. A nut is welded to the stud leaving about ½ inch of the stud protruding upwards for insertion into the socket. The nut may be turned to adjust the height of the stud. The shim-block and coupling assembly are supported by a headplate and the headplate is supported by the pier. The headplate includes a wide table for supporting a pair of jacks on opposite sides of the shim-block allowing adjustment of the foundation. The cooperation of the stud and socket help to prevent "off-set loads" which otherwise may break the piering system.

In accordance with one aspect of the invention, there is provided a piering system that makes a concentrically loaded pier stronger and provides an adjustable feature without loose components that could fall off if the structure "heaves" or moves after installation. The piering system may be used to support or lift a broken foundation requiring repair.

In accordance with another aspect of the invention, there is provided a piering system with increased "side-load" strength, thereby eliminating breakage by creating a "solid" inner pipe link between segments. The assembly that contacts the bottom of the foundation, typically has many loose adjusting components ("shims") that can fall off if the foundation "heaves" or moves after installation. The present invention provides for a wide range of adjustability without any loose components that may come loose or fall off. If the structure "heaves" up off the pier, it will return to it's properly supported position after the structure returns to its pre-heaving position.

In accordance with still another aspect of the invention, there is provided a piering system compatible with footings lacking a level base. A heave plate is fastened to the base of the footing and is supported by a shim block through a socket, allowing the footing to shift.

In accordance with yet another aspect of the invention, there is provided a method for constructing a pier system. The method includes constructing a pier performing the steps of: forming a hole reaching about 26 inches below the foundation; placing a pier base having a base cylinder portion in the bottom of the hole; placing a first outer cylinder over the base cylinder portion; inserting a first inner cylinder inside a recess in the first outer cylinder butting against the base cylinder portion; and repeating the steps of adding an additional overlapping outer cylinder and an additional inner cylinder providing a 50 percent overlap of consecutive cylinders; creating a link between the outer cylinders; and advancing the cylinders downward using a hydraulic ram until bedrock is reached. The 26 inch depth of the hole below the foundation is based on a combination of the pier segments of about 12 inches and a hydraulic ram just over 13 inched in length. If the length of the pier segments and/or the hydraulic ram are changed, the depth of the hole may change accordingly, is about the sum of the lengths.

After bedrock is reached, completing the piering system with the steps of: cutting the top cylinders to be approximately ten inches below the foundation; positioning a head plate and house jack on top of the pier to provide a stable platform; placing a heave plate between the house jack and the bottom of the foundation to distribute force applied by the house jack to the foundation; adjusting the foundation to stabilize and/or level the foundation of the structure; after adjusting is achieved, positioning additional jacks on the head plate on either side of the house jack to support the heave plate; removing the house jack; positioning a shim block and coupling assembly with the coupling assembly screwed down into the shim block; advancing the coupling assembly upward until the coupling assembly reaches into a socket of the heave plate, removing the additional jacks; drilling holes through holes in the heave plate and into the foundation; and driving concrete anchors through holes in the heave plate and into the holes drilled into the foundation to fix the heave plate to the foundation. The shim block may be attached to the head plate by bending straps over to lock the shim block to the head plate or by bolting the shim block to the head plate. The head plate and shim block thus work together to create a fully adjustable leveling mechanism that is locked together with no loose components that can fall or shift if the structure moves after installation.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
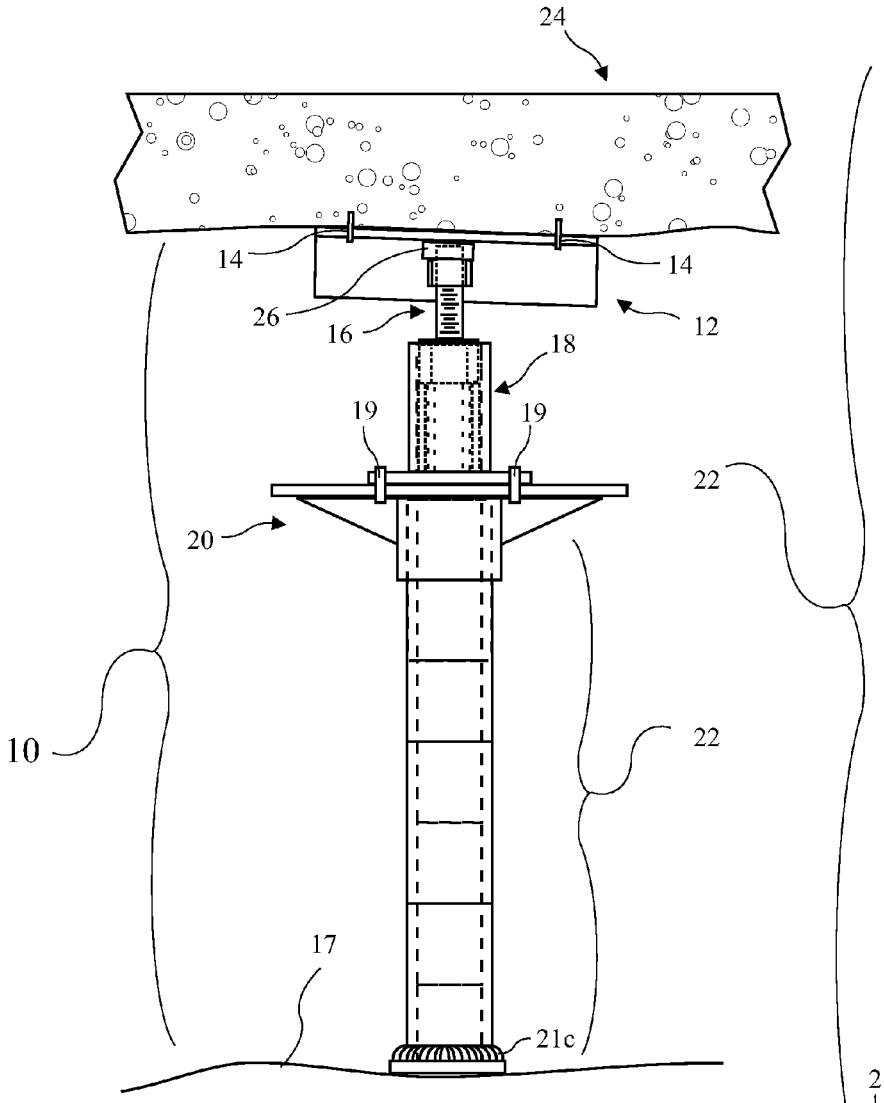
FIG. 1 shows a piering system according to the present invention supporting a foundation.

A piering system 10 according to the present invention is shown supporting a foundation 24 in FIG. 1. The piering system 10 includes a heave plate 12, a coupling assembly 16, a shim-block 18, a head plate 20 and a pier 22. The heave plate 12 is attached to the foundation 24 by attachments 14 which may be stakes, bolts, studs, or the like and fix the heave plate 12 to the foundation 24, and are preferably concrete anchors driven into the foundation 24 through pre-drilled holes 13 in the heave plate 12, permanently attaching the heave plate to the foundation. As a result, unlike known piering systems, the heave plate 12 of the piering system 10 according to the present invention moves with the foundation 24. The coupling assembly 16 reaches into a socket 26 welded or otherwise fixedly attached to the heave plate 12. The socket 26 and coupling assembly 16 are similar to a ball and socket arrangement (although the coupling assembly 16 need not have a spherical upper end) and socket 26 and coupling assembly 16 remain in engagement with the heave plate 12 through the socket 26 during typical translation, pivotal, or rotational movement of the heave plate 12 attached to the foundation 24. The socket 26 merely need be slightly larger that the top end of the coupling assembly 16. The height of the coupling assembly 16 is adjustable and eliminates the need for shims in known piering systems, which shims are often displaced and lost when the foundation 24 moves. The piering system 10 allowed simple readjustment to compensate for foundation movement.

When variations in the length of the pier 22 are desired or required, a shorter inner pipe 25 may be welded to one end of a segment, creating a coupling sleeve, thereby saving the additional steel needed to make a complete connection.

Figure 2:
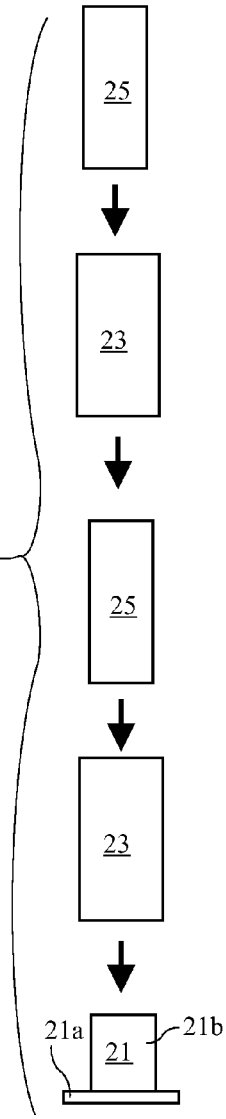
FIG. 2 shows an exploded view of a pier of the piering system.

An exploded view of a pier of the piering system 22 is shown in FIG. 2. The piering system includes a base 21 having a flange 21*a* which preferably rests on a stable base 17, for example, bed rock, outer cylinders 23 and inner cylinders 25. The cylinders overlap providing a double wall thickness for the pier 22. The bottom most outer cylinder 23 overlaps the cylinder portion 21*b* of the base 21, the bottom most inner cylinder 25 fits into the top half of the bottom most outer cylinder 23 and butts against the cylinder portion 21*b*, and such construction is repeated to form the complete pier 22. The flange 21*a* is preferably an approximately three inch diameter disk, the cylinder portion 21*b* is an approximately six inch long segment of approximately 2⅜ inch Outside Diameter (OD) pipe, the outer cylinders 23 are preferably approximately twelve inch long segment of approximately 2⅞ inch OD pipe, and the inner cylinders 25 are preferably approximately twelve inch long segment of approximately 2⅜ inch OD pipe. The cylinders are preferably made of approximately 0.220 thickness or schedule 40 steel tubing and more preferably made of schedule 40 high carbon steel tubing.

The bottom most outer cylinder 23 is preferably welded to the base 21 to prevent separation of the base 21 from the bottom most outer cylinder 23 during installation. For example, if an install drives only the inner cylinders 25, the base 21 may separate from the pier 22 and "kick" sideways in the hole, and be very difficult to re-attach. If the bottom most outer cylinder 23 is welded to the base 21, it is much easier to re-capture the larger diameter bottom most outer cylinder 23. Further, when the flange 21*a* is not much larger than the cylinder portion 21*b*, a weld bead 21*c* around the bottom of the base 21 may provide an increased diameter called a "friction ring". The friction ring pushes the soil away from the pier 22 during installation, reducing skin friction by the soil which tends to inhibit the desired depth being achieved.

Figure 3C:
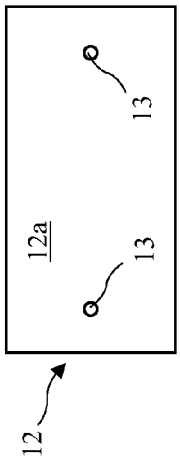
FIG. 3C is a top view of the heave plate according to the present invention.
Figure 3A:
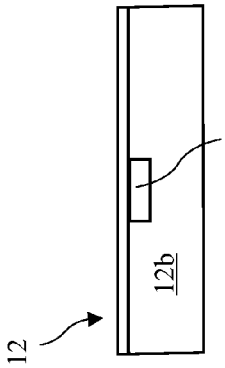
FIG. 3A is a front view of a heave plate according to the present invention.
Figure 3D:
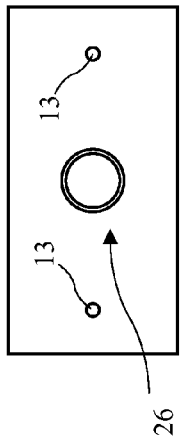
FIG. 3D is a bottom view of the heave plate according to the present invention.
Figure 3B:
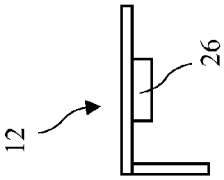
FIG. 3B is a side view of the heave plate according to the present invention.

A front view of the heave plate 12 according to the present invention is shown in FIG. 3A, a side view of the heave plate 12 is shown in FIG. 3B, a top view of the heave plate 12 is shown in FIG. 3C, and a bottom view of the heave plate 12 is shown in FIG. 3D. The heave plate 12 includes a table 12*a* for residing against the foundation 24 and a substantially vertical ledge (or angle) 12*b* attached along the length of one edge of the table 12*a* to strengthen the heave plate 12. The heave plate 12 may alternatively be cut from angle material. A socket 26 providing a lateral boundary is welded or similarly attached to a bottom surface of the table 12*a* and provides an open mouth for laterally holding the coupling assembly 16 position under the heave plate 12. The table 12*a* is preferably approximately six inches by fourteen inches and the ledge 12*b* is preferably approximately four inches high. The heave plate 12 may, for example, be cut from four by six inch, ⅜ inch thick steel angle, cut in 14 inch lengths.

Examples of the socket 26 may be a 2⅞ by ¾ inch pipe nipple, or may be a short section (e.g., about ¾ inches long) of pipe or the like welded to the bottom surface of the table 12*a*. The top of a stud 30 is captured in the socket 26. The inside diameter of the socket 26 has sufficient diameter to allow both the translation and rotation of the heave plate 12 relative to the stud 30 to allow for movement of the foundation during leveling, and later for settling. For example, angles of up to 15 to 20 degrees between the heave plate 12 and the stud 30 may be experienced if the foundation has previously settled significantly and/or the structure has been altered to compensate for the settling, and in some of these situation it may not be practical to force the foundation to level. Preferably, the inside diameter of the socket 26 is at least ¼ inches greater than the diameter of the stud 30 and is more preferably between ¼ inches and 1½ inches greater than the stud 30. In a preferred example, the stud may be 1½ inches in diameter and the inside diameter of the socket may be 2½ inches, but the stud 30 may be as small as 1 inch in diameter and the corresponding socket 26 may be 1¼ in inside diameter.

Figure 5B:
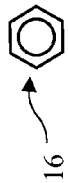
FIG. 5B is a top view of the coupling assembly according to the present invention.
Figure 5A:
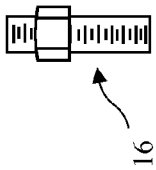
FIG. 5A is a side view of the coupling assembly according to the present invention.
Figure 4:
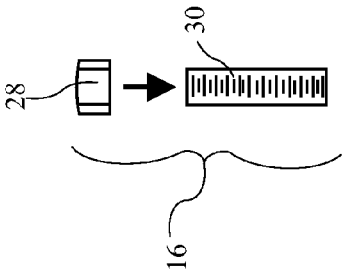
FIG. 4 is a prior to assembly side view of a coupling assembly according to the present invention.

A prior to assembly side view of the coupling assembly 16 according to the present invention is shown in FIG. 4, a side view of the assembled coupling assembly 16 is shown in FIG. 5A, and a top view of the assembled coupling assembly 16 is shown in FIG. 5B. The coupling assembly 16 is preferably constructed from an approximately seven inch length of approximately 1¼ inch diameter to approximately 1½ inch diameter grade-8 threaded material stud 30 and the nut 28 is a matching thread nut preferably welded to the stud 30, but the nut 28 may be attached using, for example, permanent Loctite® threadlock or similar material. Alternatively, other fittings may be attached to the stud to allow turning the stud for adjustment and a coupling assembly including any means for turning is intended to come within the scope of the present invention.

Figure 7B:
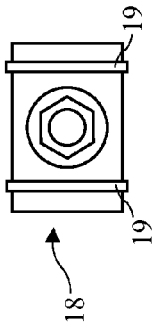
FIG. 7B is a top view of the shim block according to the present invention.
Figure 7A:
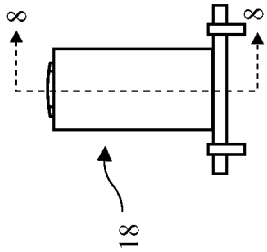
FIG. 7A is a side view of the shim block according to the present invention.
Figure 6:
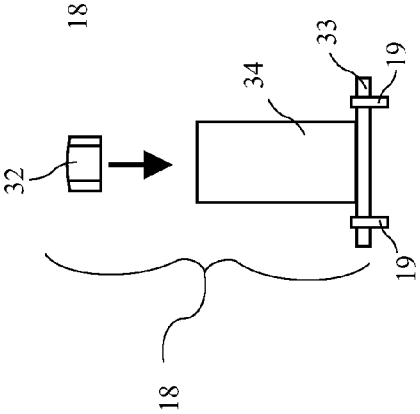
FIG. 6 is a prior to assembly side view of a shim block according to the present invention.
Figure 8:
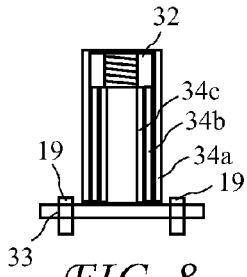
FIG. 8 is a cross-sectional view of the shim block taken along line 8-8 of FIG. 6.

A prior to assembly side view of the shim block 18 according to the present invention is shown in FIG. 6, a side view of the assembled shim block 18 is shown in FIG. 7A, a top view of the assembled shim block 18 is shown in FIG. 7B, and a cross-sectional view of the shim block 18 taken along line 8-8 of FIG. 7 is shown in FIG. 8. The shim block 18 includes a base 33, a shaft 34, and a shim block nut 32. The base 33, column 34, and nut are preferably welded together. The nut 32 is held rotationally fixed in the top of the shaft 34 has the same thread as the stud 30 allowing the coupling assembly 16 to be advanced and retreated vertically by turning the stud 30.

Figure 8A:
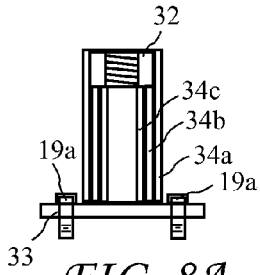
FIG. 8A is a cross-sectional view of the shim block taken along line 8-8 of FIG. 6 having bolts for attachment to the head plate.

A cross-sectional view of the shim block 18 taken along line 8-8 of FIG. 6 having bolts 19*a* for attachment to the head plate 20 is shown in FIG. 8A.

The column 34 is preferably constructed of an approximately 2¹⁄₁₆ inch pipe 34*c* inside an approximately 2⅜ inch pipe 34*b* inside an approximately 2⅞ inch pipe 34*a*, and the pipes 34*b* and 34*c* are preferably recessed approximately ½ inches into the pipe 34*a* providing a recess and vertical support for the nut 32. The base 33 preferably measures approximately 4 inches by approximately 4 inches, and is preferably approximately ½ inch thick steel plate.

Straps 19 (also see FIGS. 9A 10*a* and 10B) are provided to attach the shim block 18 to the head plate 20. The straps 19 are preferably welded to the base 33 on both sides of the shim block 18. The straps 19 allow the shim block 18 to be locked to the head plate 20 using only a hammer. In an alternative embodiment, the straps 19 are replaced by two bolts in opposite front corners attaching the shim block 18 to the head plate 20.

Figure 9C:
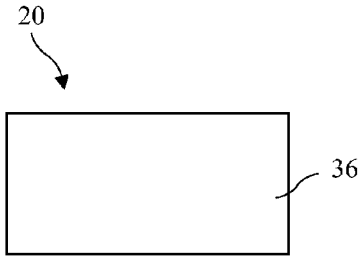
FIG. 9C is a top view of the head plate according to the present invention.
Figure 9A:
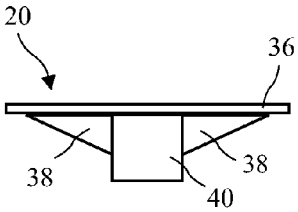
FIG. 9A is a front view of a head plate according to the present invention.
Figure 9B:
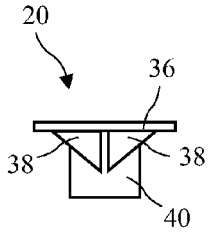
FIG. 9B is a side view of the head plate according to the present invention.
Figure 9D:
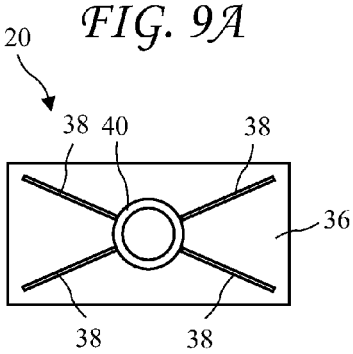
FIG. 9D is a bottom view of the head plate according to the present invention.

A front view of the head plate 20 according to the present invention is shown in FIG. 9A, a side view of the head plate 20 is shown in FIG. 9B, a top view of the head plate 20 is shown in FIG. 9C, and a bottom view of the head plate 20 is shown in FIG. 9D. The head plate 20 includes a head plate table 36, head plate cylinder 40, and gussets 38. The table 36 supports the shim block 18 and is preferably made from approximately six inches by approximately fourteen inches of ½ inch thick steel plate. The cylinder 40 is welded to the bottom of the table 36 and is sized to fit over the top of the pier 22 and is approximately six inches high. The gussets 38 brace the table 36 to the cylinder 40.

Figure 10A:
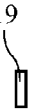
FIG. 10A is a front view of a strap according to the present invention.
Figure 10B:
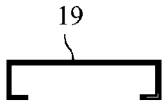
FIG. 10B is an edge view of the strap according to the present invention.

A front view of the strap 19 according to the present invention is shown in FIG. 10A and an edge view of the strap 19 is shown in FIG. 10B. The straps 19 are preferably approximately eight inches long and are made from approximately ½ inch by approximately ¼ inch steel strap.

A method for constructing a pier system according to the present invention includes the following steps. A hole is formed about 26 inches below the foundation 24. The base 21 including a cylinder portion 21*b* is placed in the bottom of the hole. A first outer cylinder 23 is placed over the cylinder portion 21*b* creating a six inch recess inside the outer cylinder 23. A first inner cylinder 25 is placed inside the recess in the first outer cylinder 23 butting against the cylinder portion 21*b*. The steps of adding an additional overlapping outer cylinder 23 and an additional inner cylinder 25 are repeated providing a 50 percent overlap of consecutive cylinders 23 and 25 creating a link between the outer cylinders 23 which cannot be broken because the inner cylinders 23 extend six inches on both sides of the joint between the outer cylinder 23. The cylinders 23 and 25 are added and the forming pier 22 is advanced downward using a hydraulic ram until a stable base, preferably bedrock, is reached.

Figure 12:
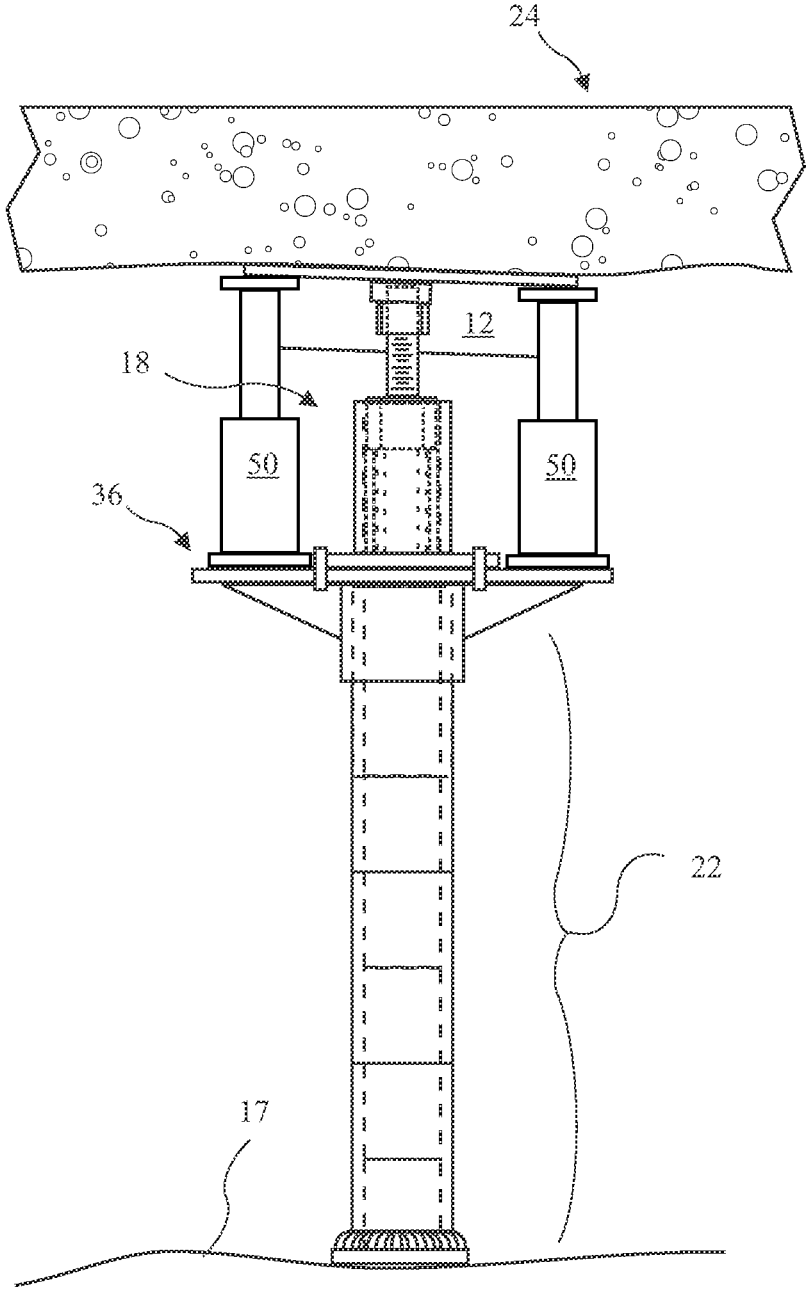
FIG. 12 shows the piering system according to the present invention supporting a foundation with two house jacks supporting a heave plate.

After the stable base is reached, the top most cylinders 23 and 25 are cut to be approximately ten inches below the foundation 24. The head plate 20 is positioned on top of the pier 22 to provide a stable platform for a house jack (preferably a ten-ton house jack) which is used in conjunction with other piers 22 and house jacks to adjust (i.e., stabilize and/or level) the foundation 24 of the structure. A heave plate 12 is sandwiched between the house jack 50 and the foundation 24 to distribute the lifting force of the house jack 50 to avoid damaging the foundation 24 as seen in FIG. 12. After stabilization is achieved, additional jacks are placed on the head plate 20 either side of the house jack to support the heave plate 12 and foundation 24, and the house jack is removed. The house jack is replaced by the shim block 18 with the coupling assembly 16 screwed down into the shim block 18. The shim block 18 which is adjusted by turning the coupling assembly 16 until the coupling assembly 16 reaches into the socket 26 of the heave plate 12. The additional jacks may then be removed. Holes are drilled through the holes 13 in the heave plate 12 and into the bottom of the foundation 24 and concrete anchors 14 are driven through the holes 13 in the heave plate 12 and into the holes to fixedly attach the heave plate 12 to the foundation 24. The straps 19 are then bent over to lock the shim block 18 to the head plate 20 or bolts are installed attaching the shim block 18 to the head plate 20. The head plate 20, shim block 18, and heave plate 16 thus work together to create a fully adjustable leveling mechanism that is locked together with no loose components that can fall or shift if the structure moves after installation.

Figure 11A:
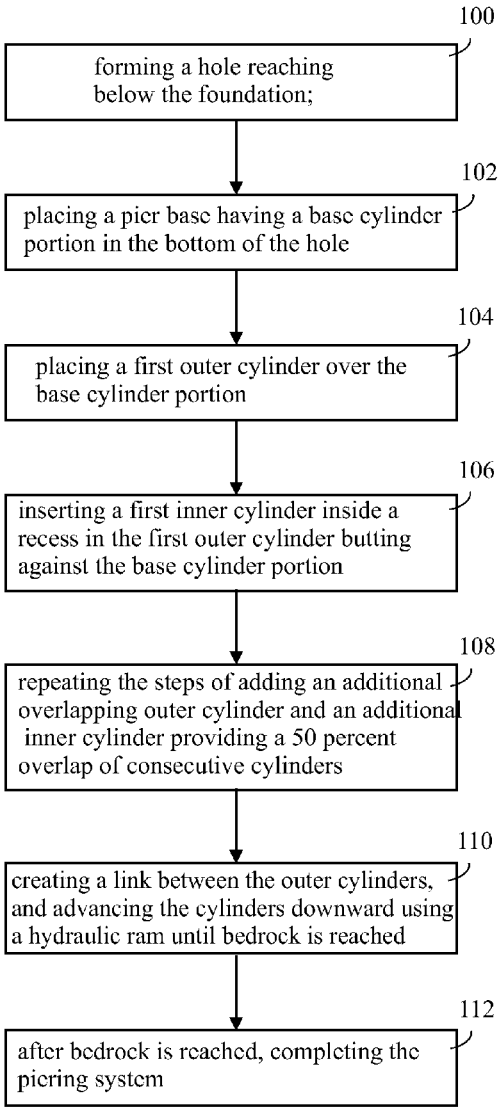
FIG. 11A describes a method for constructing a pier system according to the present invention.

A method for constructing a pier system according to the present invention is described in FIG. 11A. The method includes constructing a pier performing the steps of: forming a hole below the foundation at step 100; placing a pier base having a base cylinder portion in the bottom of the hole at step 102; placing a first outer cylinder over the base cylinder portion at step 104; inserting a first inner cylinder inside a recess in the first outer cylinder butting against the base cylinder portion at step 106; and repeating the steps of adding an additional overlapping outer cylinder and an additional inner cylinder providing a 50 percent overlap of consecutive cylinders at step 108; creating a link between the outer cylinders and advancing the cylinders downward using a hydraulic ram until bedrock is reached at step 110, and after bedrock is reached, completing the piering system at step 112. The 26 inch depth of the hole formed in step 100 below the foundation is based on a combination of the pier segments of about 12 inches and a hydraulic ram just over 13 inches in length. If the length of the pier segments and/or the hydraulic ram are changed, the depth of the hole may change accordingly, and is preferable slightly greater than the sum of the lengths.

Figure 11B:
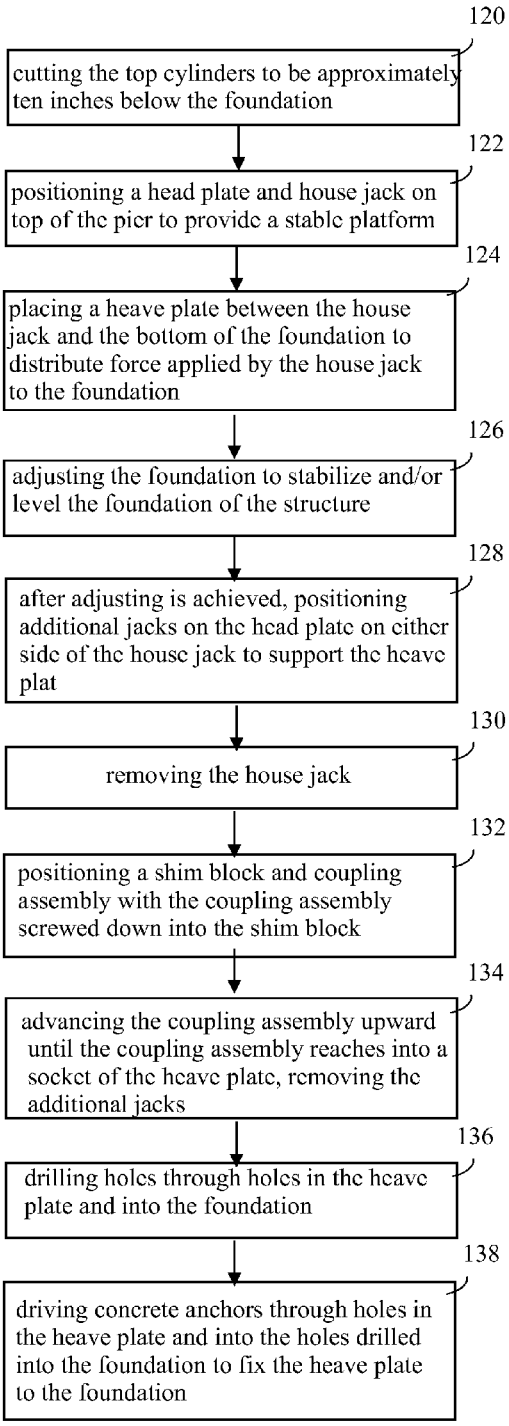
FIG. 11B describes a method for completing a pier system according to the present invention.

A method for completing a pier system 112 according to the present invention is described in FIG. 11B. After bedrock is reached, completing the piering system with the steps of: cutting the top cylinders to be approximately ten inches below the foundation at step 120; positioning a head plate and a house jack on top of the pier to provide a stable platform at step 122; placing a heave plate between the house jack and the bottom of the foundation to distribute force applied by the house jack to the foundation at step 124; adjusting the foundation to stabilize and/or level the foundation of the structure at step 126; after adjusting is achieved, positioning additional jacks on the head plate on either side of the house jack to support the heave plate at step 128; removing the house jack at step 130; positioning a shim block and coupling assembly with the coupling assembly screwed down into the shim block at step 132; advancing the coupling assembly upward until the coupling assembly reaches into a socket of the heave plate, removing the additional jacks at step 134; drilling holes through holes in the heave plate and into the foundation at step 136; and driving concrete anchors through holes in the heave plate and into the holes drilled into the foundation to fix the heave plate to the foundation at step 138. The shim block may be attached to the head plate by bending straps over to lock the shim block to the head plate or by bolting the shim block to the head plate. The head plate and shim block thus work together to create a fully adjustable leveling mechanism that is locked together with no loose components that can fall or shift if the structure moves after installation.

Placing a house jack on the head plate in step 122 may be placing a single house jack or a pair of house jacks. When a pair of house jacks are used to adjust the foundation, the step of placing additional jacks in step 128 is not required. Further, a hydraulic manifold jacking system may be used which provides jacks attached to a computer directed pump that lifts all the jacks at the same time instead of using bottle jacks.

While the invention herein disclosed has been described by means of specific embodiments and applications thereof, numerous modifications and variations could be made thereto by those skilled in the art without departing from the scope of the invention set forth in the claims.

I claim:

1. A piering system for supporting a foundation, the piering system comprising:

a pier comprising a starter segment made of pipe welded to a disc and a first larger diameter segment overlapping the pipe and welded to the pipe and disk, and alternating overlapping smaller diameter segments and the larger diameter segments, the smaller diameter segments fitting inside the larger diameter segments;

a head plate supported by the pier, the head plate com prising:

a head plate pipe sliding onto the top of the pier; and a head plate table welded to a head plate pipe and covering the top of the head plate pipe, the head plate table resting on the top of the pier; and a shim block residing on top of the head plate table leaving space on the head plate table to place a jack for supporting the foundation, the shim block comprising:

an outer pipe;

an inner pipe inside the outer pipe recessed into the top of the outer pipe;

a shim block base attached to the bottom of the outer pipe to prevent the inner pipe from falling out; and a shim block nut rotationally fixed inside the top of the outer pipe;

a threaded stud screwed into the shim block nut;

a heave plate residing on top of the threaded stud, having a socket welded near the center of a bottom surface of the heave plate to receive the threaded stud for providing vertical support to the heave plate, an interior of the socket about one inch larger diameter than the threaded stud allowing translation and tilt of the heave plate with respect to the threaded stud; and at least two attachments configured for permanently fixedly connecting the heave plate to the foundation.

2. A piering system for supporting a foundation, the piering system comprising:

a pier reaching downward under the foundation to a stable base;

a head plate vertically supported by the pier and including a head plate table above the pier;

a shim block vertically supported above the head plate table and adjustable in height, the shim block having a foot print on the head plate table leaving room on the head plate table to support at least one jack for supporting the foundation during construction of the piering system; and a heave plate fixedly attached to a bottom surface of the foundation and vertical rotatably supported by the shim block allowing tilt of the heave plate with respect to the shim block.

3. The piering system of claim 2, wherein the heave plate may pivot with respect to the shim block to compensate for angled bottom surfaces of the foundation.

4. The piering system of claim 3, wherein the heave plate includes a downward opening socket and the shim block includes an upward reaching stud loosely residing in the socket to allow the heave plate to pivot with respect to the shim block to compensate for angled bottom surfaces of the foundation.

5. The piering system of claim 4, wherein:

the upward reaching stud is a threaded stud, and is threaded into a nut fixed to the shim block; and the stud may be turned to advance or retreat vertically to adjust the height of the heave plate with respect to the shim block.

6. The piering system of claim 5, wherein the upward reaching stud is an approximately 1½ inch diameter threaded stud and the socket has approximately a 2½ inch inside diameter.

7. The piering system of claim 3, wherein the shim block comprises:

a horizontal base;

a vertical column;

a fixed nut welded proximal to the top of the column; and the threaded stud screwed into the fixed nut.

8. The piering system of claim 2, wherein the heave plate is attached to the foundation by at least two permanent attachments.

9. The piering system of claim 8, wherein the heave plate is attached to the foundation by at least two concrete anchors driven through holes in the heave plate and into the foundation.

10. The piering system of claim 9, wherein the heave plate comprises a section of steel angle.

11. The piering system of claim 9, wherein the heave plate comprises an approximately 14 inch long section of six inch by four inch, ⅜ inch thick steel angle.

12. The piering system of claim 2, wherein the pier comprises overlapping inner and outer cylinders reaching down to the stable base and cut off approximately ten inches below the foundation.

13. The piering system of claim 12, wherein the head plate comprises:

an approximately horizontal head plate table; and a head plate cylinder reaching downward from the head plate table and fitting over the top of the pier to position the head plate vertically supported by the pier.

14. The piering system of claim 13, wherein the head plate table has sufficient surface area to carry a house jack approximately centered on the head plate table and at least one additional jack beside the house jack.

15. The piering system of claim 14, wherein the head plate table is approximately six inches by approximately fourteen inches of steel plate for providing support for the house jack and two additional jack, one on each side of the house jack.

16. The piering system of claim 2, wherein the shim block is attached to the head plate by two bolts.

17. The piering system of claim 2, wherein the shim block is attached to the head plate by two straps.

18. A method for constructing a pier system to stabilize and level a structure, the method comprising:

constructing a pier comprising the steps of:

forming hole below the foundation;

placing a pier base having a base cylinder portion and a first outer cylinder over the base cylinder portion and welded to the pier base, in the bottom of the hole;

inserting a first inner cylinder inside a recess in the first outer cylinder, the first inner cylinder butting against the base cylinder portion;

inserting a second outer cylinder overlapping the first inner cylinder and butting against the first outer cylinder; and repeating the steps of adding an additional overlapping outer cylinder and an additional inner cylinder providing a 50 percent overlap of consecutive cylinders creating a link between the outer cylinders and advancing the cylinders downward using a hydraulic ram until bedrock is reached;

completing the piering system comprising the steps of:

cutting the top most cylinders to be approximately ten inches below the foundation;

positioning a head plate on top of the pier to provide a stable platform for a house jack;

positioning at least one jack on the head plate;

positioning a heave plate between the house jack and the foundation;

using the jack to apply a vertical lifting force to lift the foundation of the structure to adjust the structure, the heave plate distributing the lifting force to avoid damage to the foundation;

after adjustment is finished, positioning a shim block and coupling assembly on the head plate;

advancing the coupling assembly upward until the coupling assembly reaches into a socket of the heave plate;

removing the jack;

drilling holes through the holes in the heave plate into the foundation; and driving concrete anchors through the holes in the heave plate and into the holes drilled into the foundation to fix the heave plate to the foundation.

19. The method of claim 18, further including bending straps over to lock the shim block to the head plate.

20. The method of claim 18, further including bolting the shim block to the head plate.

21. A piering system for supporting a foundation, the piering system comprising:

a pier configured to reach generally vertically downward to a stable base;

a head plate table vertically supported by the pier;

a shim block vertically supported by the pier and adjustable in height, the shim block having a horizontal envelope with respect to the head plate table leaving an area on the head plate table to support at least one jack for supporting a foundation during construction of the piering system;

a heave plate having a generally flat heave plate table configured to reside against a bottom surface of a foundation; and lips projecting down from a bottom surface of the heave plate table, the lips providing a lateral boundary for the contact of the shim block with the heave plate, the shim block vertically supporting the heave plate.

22. The piering system of claim 21, wherein the leave plate includes a generally vertical ledge extending downward along one edge of the heave plate table.

23. The piering system of claim 21, wherein the pier comprises a starter segment made of pipe welded to a disc and a first larger diameter segment overlapping the pipe and welded to the pipe and disk, and alternating overlapping smaller diameter segments and the larger diameter segments, the smaller diameter segments fitting inside the larger diameter segments.

24. The piering system of claim 21, wherein the at least one jack comprises two house jacks residing in contact between the head plate table and the heave plate, and the head plate table includes generally horizontal surfaces on opposite sides of the shim block, supporting the two house jacks.

25. The piering system of claim 21, wherein the shim block is not attached to heave plate.

26. The piering system of claim 21, wherein:

the pier reaches generally vertically downward to the stable base;

the at least one jack comprises two removable house jacks on opposite sides of the shim block, the two jacks supported by the head plate table;

the heave plate table resides against the bottom surface of the foundation; and the shim block holds the heave plate against the bottom surface of the foundation, allowing the heave plate to tilt to align with the bottom surface of the foundation.

* * * * *